US009378711B1

(12) United States Patent
Stadnyk

(10) Patent No.: US 9,378,711 B1
(45) Date of Patent: Jun. 28, 2016

(54) RECONFIGURABLE GUITAR SYSTEM

(71) Applicant: Mark A. Stadnyk, Inverness, FL (US)

(72) Inventor: Mark A. Stadnyk, Inverness, FL (US)

( * ) Notice: Subject to any disclaimer, the term of this patent is extended or adjusted under 35 U.S.C. 154(b) by 0 days.

(21) Appl. No.: 14/283,261

(22) Filed: May 21, 2014

(51) Int. Cl.
*G10D 1/08* (2006.01)

(52) U.S. Cl.
CPC . *G10D 1/085* (2013.01); *G10D 1/08* (2013.01)

(58) Field of Classification Search
CPC ..... G10D 1/08; G10D 1/085
See application file for complete search history.

(56) References Cited

U.S. PATENT DOCUMENTS

| | | | | | |
|---|---|---|---|---|---|
| 2,561,551 | A | * | 7/1951 | Allen | 84/723 |
| 3,072,007 | A | * | 1/1963 | Burke | 84/267 |
| 3,194,870 | A | * | 7/1965 | Tondreau et al. | 84/726 |
| 3,396,621 | A | * | 8/1968 | Dycus | 84/293 |
| 3,413,883 | A | * | 12/1968 | Helbourne | 84/267 |
| 3,439,570 | A | * | 4/1969 | Lee | 84/293 |
| 3,538,807 | A | * | 11/1970 | Francis | 84/267 |
| 3,696,700 | A | * | 10/1972 | Berardi | 84/291 |
| 3,771,408 | A | * | 11/1973 | Wright | 84/291 |
| 3,910,151 | A | * | 10/1975 | Copeland | 84/267 |
| 4,126,073 | A | * | 11/1978 | Takabayashi | 84/293 |
| 4,185,534 | A | * | 1/1980 | Cove | 84/291 |
| 4,254,683 | A | * | 3/1981 | Nulman | 84/727 |
| 4,359,923 | A | * | 11/1982 | Brunet | 84/267 |
| 4,432,267 | A | * | 2/1984 | Feller | 84/293 |
| 4,433,603 | A | * | 2/1984 | Siminoff | 84/726 |
| D299,453 | S | * | 1/1989 | Brunet | D17/20 |
| 4,873,908 | A | * | 10/1989 | Moore | 211/84 |
| 5,058,479 | A | * | 10/1991 | Shaw | 84/291 |
| 5,131,307 | A | * | 7/1992 | Castillo | 84/267 |
| 5,347,904 | A | * | 9/1994 | Lawrence | 84/291 |
| 5,929,362 | A | * | 7/1999 | Oteyza | 84/743 |
| 6,046,392 | A | * | 4/2000 | Saul | 84/291 |
| 6,233,825 | B1 | * | 5/2001 | DeGroot | 29/896.22 |
| 6,255,567 | B1 | * | 7/2001 | Minakuchi | 84/291 |
| 6,653,538 | B1 | * | 11/2003 | Wells | 84/291 |
| 6,664,461 | B2 | * | 12/2003 | Tamura | 84/743 |
| 6,791,022 | B2 | * | 9/2004 | Green | 84/731 |
| 6,809,245 | B2 | * | 10/2004 | Sawhney et al. | 84/291 |
| 7,002,065 | B2 | * | 2/2006 | Petersen | 84/290 |
| 7,442,865 | B2 | * | 10/2008 | Moghaddam | 84/290 |
| 7,816,592 | B2 | * | 10/2010 | Babicz | 84/293 |
| 8,378,192 | B1 | * | 2/2013 | Harmon | 84/291 |
| 2003/0164080 | A1 | * | 9/2003 | Childress | 84/291 |
| 2003/0188622 | A1 | * | 10/2003 | Wilson | 84/267 |
| 2014/0116226 | A1 | * | 5/2014 | Saito et al. | 84/291 |

* cited by examiner

*Primary Examiner* — Robert W Horn

(57) ABSTRACT

A central neck portion has planar left and right lateral edges. Laterally spaced left and right body regions have planar interior edges corresponding to planar left and right lateral edges of a central core portion. The left and right body regions have non-planar exterior edges forming continuous peripheries with hollow centers. Coupling components separably couple the planar interior edges of the left and right body regions to the left and right lateral edges of the central core portion.

15 Claims, 4 Drawing Sheets

RECONFIGURABLE GUITAR SYSTEM

BACKGROUND OF THE INVENTION

Field of the Invention

The present invention relates to a reconfigurable guitar system and more particularly pertains to separating laterally spaced body regions from a central neck portion and central core portion and for coupling any of a plurality of laterally spaced body regions to the neck portion and core portion, the separating and the coupling being done in a safe, convenient, and economical manner.

SUMMARY OF THE INVENTION

In view of the disadvantages inherent in the known types of guitar systems of known designs and configurations now present in the prior art, the present invention provides an improved reconfigurable guitar system. As such, the general purpose of the present invention, which will be described subsequently in greater detail, is to provide a new and improved reconfigurable guitar system and method which has all the advantages of the prior art and none of the disadvantages.

To attain this, the present invention essentially comprises a central core portion with a planar left lateral edge and a planar right lateral edge. A central neck portion has a planar left and right lateral edges. Laterally spaced left and right body regions have planar interior edges corresponding to planar left and right lateral edges of a central core portion. The left and right body regions have non-planar exterior edges forming continuous peripheries with hollow centers. Coupling components separably couple the planar interior edges of the left and right body regions to the left and right lateral edges of the central core portion.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved reconfigurable guitar system which has all of the advantages of the prior art guitar systems of known designs and configurations and none of the disadvantages.

It is another object of the present invention to provide a new and improved reconfigurable guitar system which may be easily and efficiently manufactured and marketed.

It is further object of the present invention to provide a new and improved reconfigurable guitar system which is of durable and reliable constructions.

An even further object of the present invention is to provide a new and improved reconfigurable guitar system which is susceptible of a low cost of manufacture with regard to both materials and labor, and which accordingly is then susceptible of low prices of sale to the consuming public, thereby making such reconfigurable guitar system economically available to the buying public.

Lastly, another object of the present invention is to provide a reconfigurable guitar system for separating laterally spaced body regions from a central neck portion and central core portion and for coupling any of a plurality of laterally spaced body regions to the neck portion and core portion, the separating and the coupling being done in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figures 1, 2:
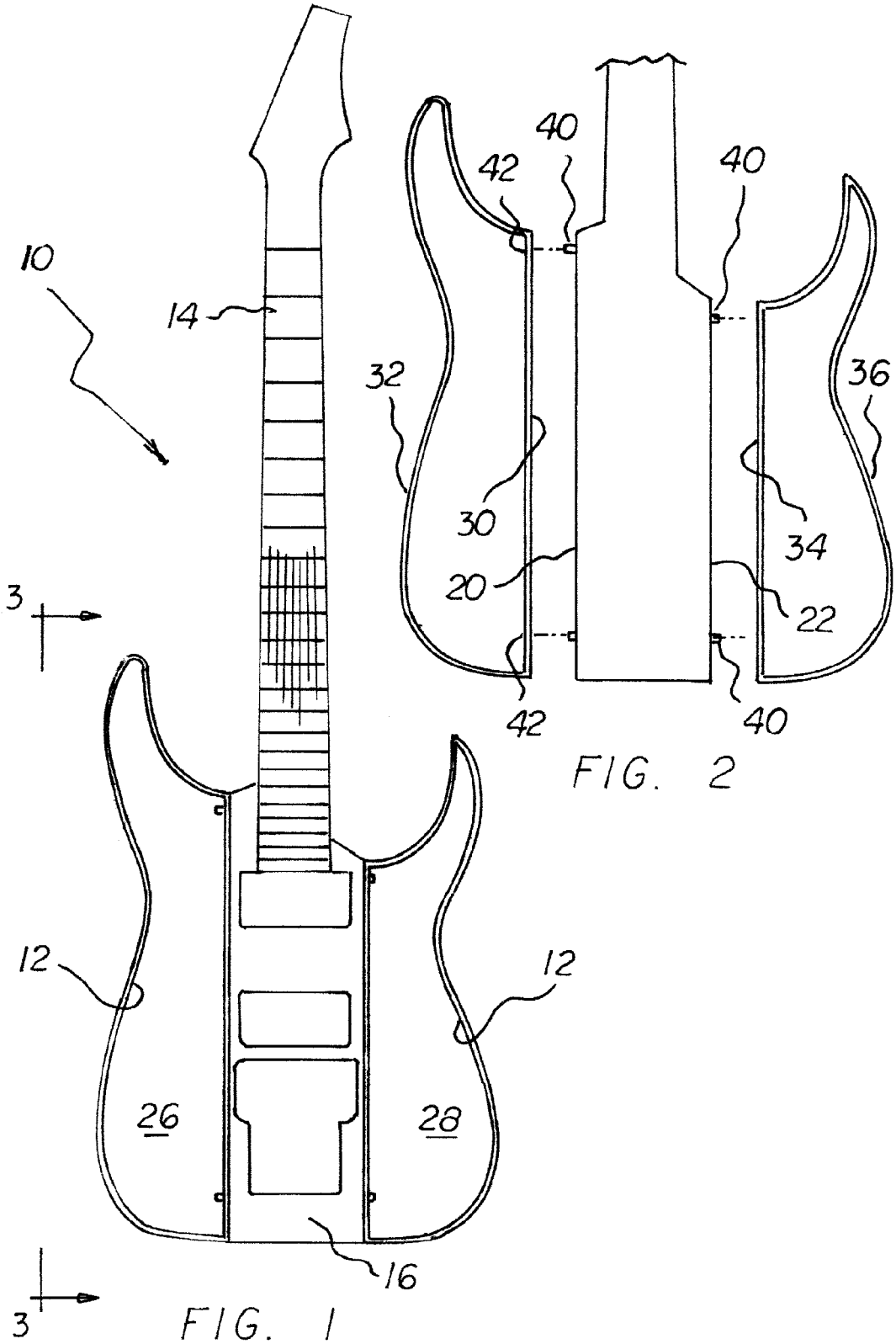
FIG. 1 is a front elevational view of a reconfigurable guitar system constructed in accordance with the principles of the present invention.
FIG. 2 is an exploded illustration of the lower extent of the system shown in FIG. 1.

With reference now to the drawings, and in particular to FIG. 1 thereof, the preferred embodiment of the new and improved reconfigurable guitar system embodying the principles and concepts of the present invention and generally designated by the reference numeral 10 will be described.

The present invention, the reconfigurable guitar system 10 is comprised of a plurality of components. Such components in their broadest context include a central neck portion, a central core portion, laterally spaced body regions, and coupling components. Such components are individually configured and correlated with respect to each other so as to attain the desired objective.

First provided is a central neck portion 14. The central neck portion has a first length and a first width. A central core portion 16 is provided. The central core portion has a second length and a second width. The first length is greater than the second length. The first width is less than the second width. The central core portion has a planar left lateral edge 20. The planar left lateral edge has a length. The central core portion has a planar right lateral edge 22. The planar right lateral edge has a length. The length of the planar left lateral edge is greater than the length of the planar right lateral edge.

Laterally spaced body regions 12 are provided. The laterally spaced body regions include a left body region 26 and a right body region 28. The left body region includes a planar interior edge 30. The planar interior edge of the left body region is of a same size and shape corresponding to the planar left lateral edge of the central core portion. The left body region also includes a non-planar exterior edge 32. The interior and exterior edges of the left body regions form a continuous periphery. The continuous periphery has a hollow center. The right body region includes a planar interior edge 34. The planar interior edge is of a same size and shape corresponding to the planar right lateral edge of the central core portion. The right body region also includes a non-planar exterior edge 36. The interior and exterior edges of the right body regions form a continuous periphery. The continuous periphery has a hollow center.

Provided last are left coupling components. The coupling components separably couple the planar interior edge of the left body region to the left lateral edge of the central core portion. The left and right coupling components include outwardly extending pins 40. The outwardly extending pins are provided on the left and right edges of the central core portion. The left and right coupling components include apertures 42. The apertures are provided on the left and right interior edges of the left and right body regions. The apertures are adapted to removably receive the pins. In this manner the left and right body regions are coupled and uncoupled the core portion.

Figure 3:
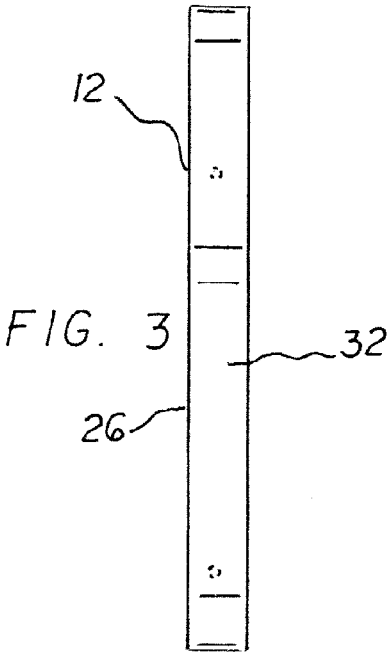
FIG. 3 is a side elevational view taken along line 3-3 of FIG. 1.

Reference is now made to the embodiment of FIGS. 1-3. The left and right body regions are separate portions.

Figure 4:
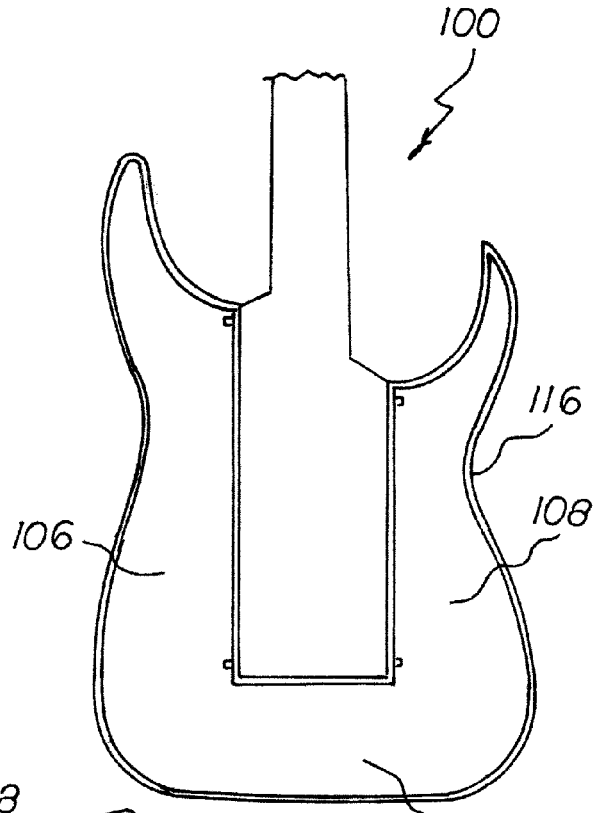
FIGS. 4 and 5 are front elevational views of an alternate embodiment of the invention wherein the body is of a one piece construction.
Figure 5:
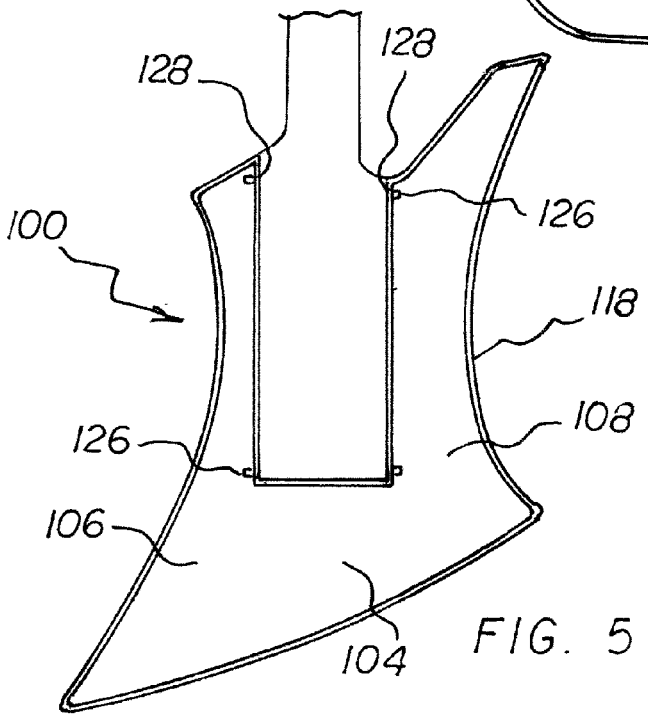

Reference is now made to the embodiment 100 of FIGS. 4 and 5. Further included is a transverse portion 104. Left and right body regions 106, 108, are provided. The transverse portion is integrally formed with the left and right body regions. A central core portion is provided. The transverse portion is positionable beneath and in contact with the central core portion 112. In this manner a replaceable assembly 116 is provided.

The replaceable assembly is a plurality of replaceable assemblies 218. Each of the plurality of replaceable assemblies has a periphery of a different configuration from each of the other replaceable assemblies.

The coupling components include cylindrical elements 126 and apertures 128. The cylindrical elements and apertures are provided in the interior edges and in the lateral edges. The cylindrical elements are adapted to be inserted into the apertures. In this manner the core portion and the replaceable assemblies are coupled.

Figure 6:
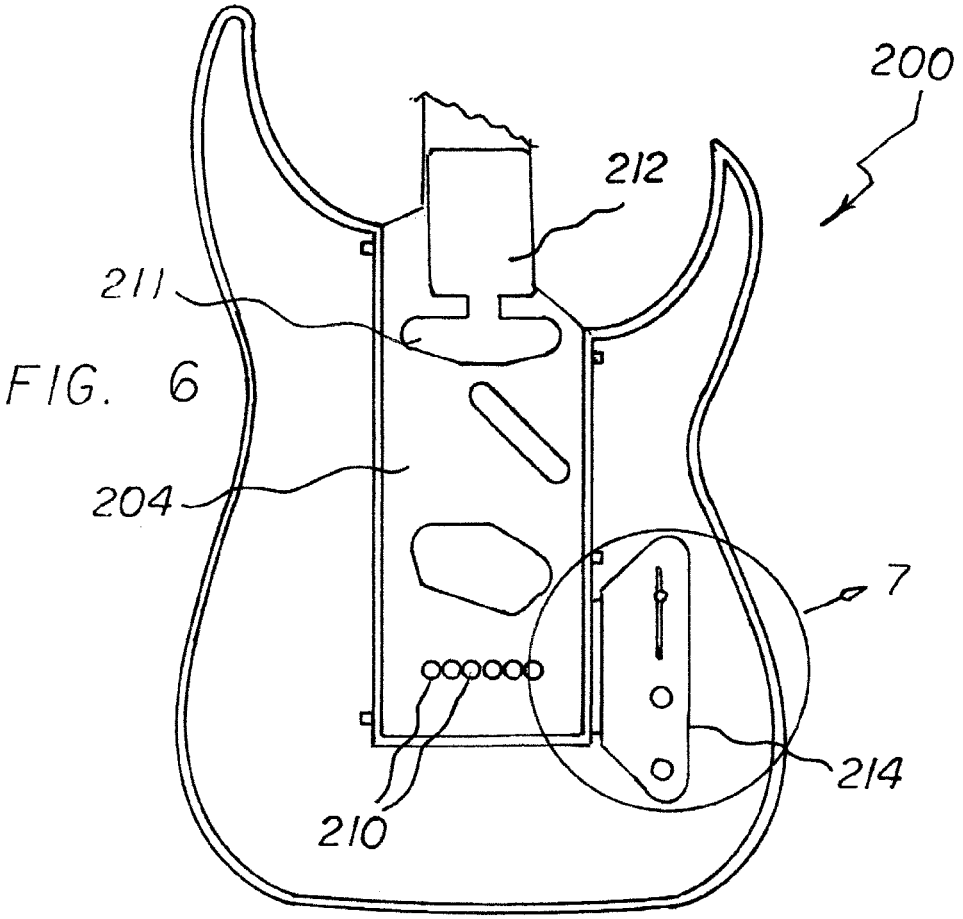
FIG. 6 is a front elevational view of another alternate embodiment of the invention featuring a control panel.
Figure 7:
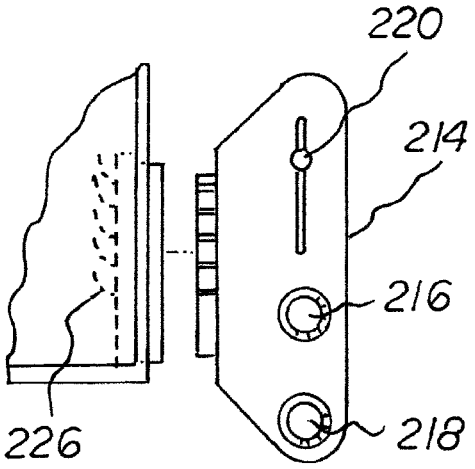
FIGS. 7 and 8 are exploded front elevational views of different control panels.
Figure 8:
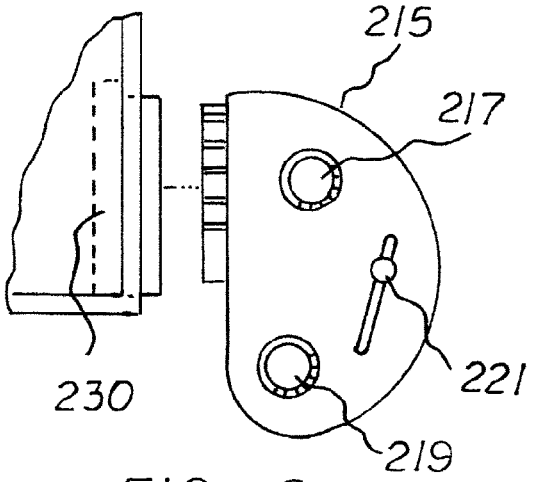

Reference is now made to the embodiment 200 of FIGS. 6-8. A central core portion 204 is provided.

The central core portion includes first pick-ups 210. The first pick-ups are adapted to create sound in response to the strumming of the guitar strings.

A controller 214 is provided. The controller has a first dial 216. The first dial is adapted to vary the volume. The controller has a second dial 218. The second dial is adapted to vary the tone. The core also has second pick-ups 211 adjacent to neck 212. The controller further has a slider 220. The slider 220 is adapted to allow the user to choose one or more of the pickups to become active.

Wires 226 are provided. The wires couple the controller to the first and second pick-ups.

A wireless means 230 is provided. The wireless means couples the first and second pick-ups. In association with the wireless means is the wireless controller 215 with a volume dial 217, a tone dial 219, and a second slider 221.

Figure 9:
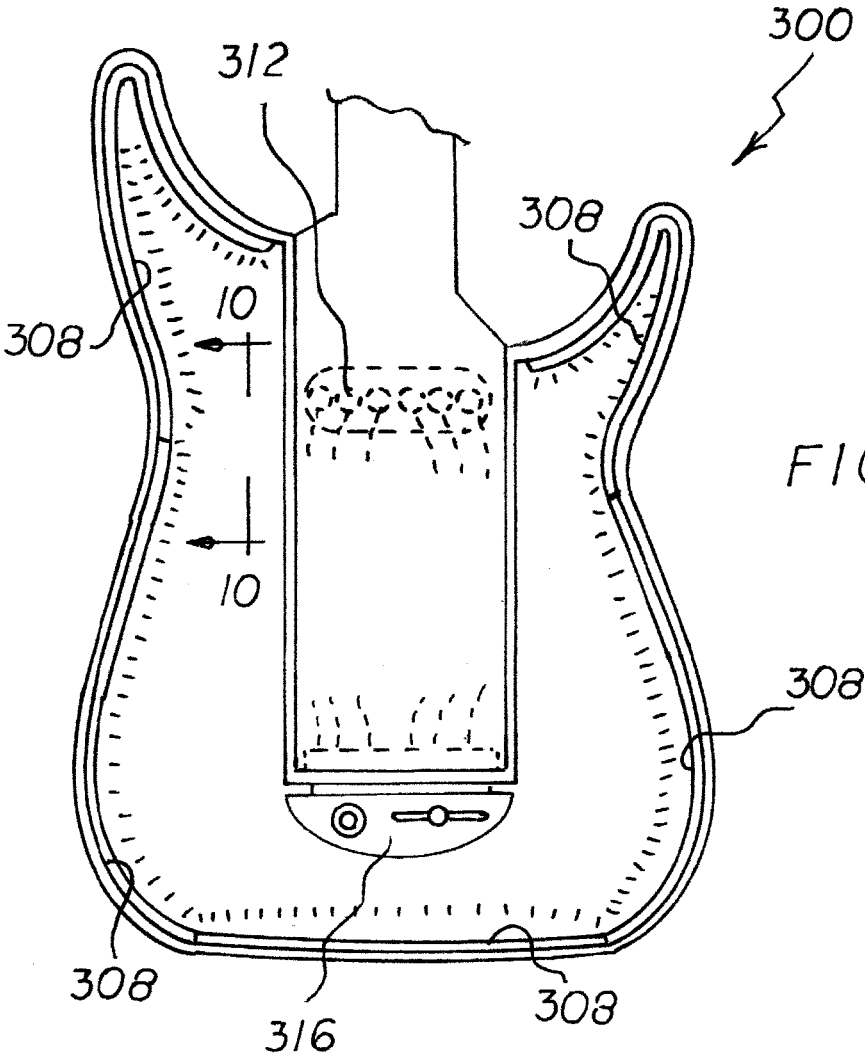
FIG. 9 is a front elevational view of the final embodiment of the invention.
Figure 10:
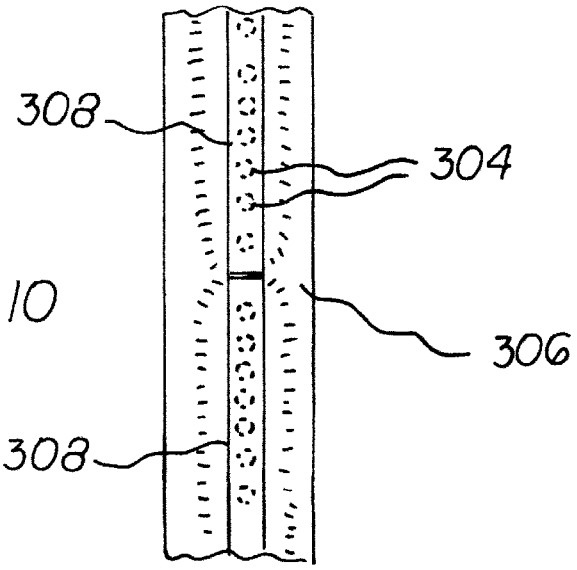
FIG. 10 is a cross sectional view taken along line 10-10 of FIG. 9.

Reference is now made to the embodiment 300 of FIGS. 9 and 10. A plurality of light emitting diodes 304 is provided. The left and right body regions have exterior edges 306. The light emitting diodes are coupled to the exterior edges of the left and right body regions.

The plurality of light emitting diodes is in a plurality of segments 308.

Provided last is a plurality of pick-ups 312. The pick-ups extend across the central core portion. The pick-ups are adapted to be contacted in response to a user contacting strings there above. A controller 316 is provided. The controller couples the light emitting diodes and the pick-ups. The controller includes a plurality of dials and a slider.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A reconfigurable guitar system comprising:

a central neck portion and a central core portion, the central core portion having a planar left lateral edge and a planar right lateral edge;

laterally spaced body regions including a left body region and a right body region, the left body region and the right body region having planar interior edges corresponding to the planar left and right lateral edges of the central core portion, the left body region and the right body region also including non-planar exterior edges forming continuous peripheries with hollow centers; and coupling components separably coupling the planar interior edges of the left and right body regions to the left and right lateral edges of the central core portion.

2. The system as set forth in claim 1 wherein the left and right body regions are separate portions.

3. The system as set forth in claim 1 wherein the left lateral edge and the interior edge of the left body region are of a first length and the right lateral edge and the interior edge of the right body region are of a second length different from the first length.

4. The system as set forth in claim 1 wherein the coupling components include cylindrical elements and apertures, the cylindrical elements extending laterally from the left and right lateral edges, the apertures extending through the interior edges of the left and right body regions.

5. The system (100) as set forth in claim 1 and further including a transverse portion (104) integrally formed with the left and right body regions (106), (108), the transverse portion positionable beneath and in contact with the central core portion (112), the transverse portion with the left and right body regions constituting a replaceable assembly (116).

6. The system as set forth in claim 5 wherein the replaceable assembly includes a plurality of replaceable assemblies (120), (122), each of the plurality of replaceable assemblies having a periphery of a different configuration from each of the other replaceable assemblies.

7. The system as set forth in claim 6 wherein the coupling components include cylindrical elements (126) and apertures (128) in the interior edges and in the lateral edges, the cylindrical elements adapted to be inserted into the apertures to couple the core portion and the replaceable assemblies.

8. The system (200) as set forth in claim 1 and further including first pick-ups (210) and second pick-ups (211) adapted to create sounds in response to the strumming of the guitar strings.

9. The system as set forth in claim 8 and further including:

a controller (214) having a first dial (216) adapted to vary the volume, a second dial (218) adapted to vary the tone and second pick-ups (211) with a slider (222) adapted to allow the user to choose the pickups to become active.

10. The system as set forth in claim 8 and further including wires (226) coupling the controller to the first and second pick-ups.

11. The system as set forth in claim 8 and further including a wireless means (230) coupling the first and second pick-ups.

12. The system (300) as set forth in claim 1 and further including a plurality of light emitting diodes (304) coupled to the exterior edges (306) of the left and right body regions.

13. The system as set forth in claim 12 wherein the plurality of light emitting diodes is in a plurality of segments (308).

14. The system as set forth in claim 12 and further including a plurality of pick-ups (312) extending across the central core portion adapted to be contacted in response to a user contacting strings there above, a controller (316) coupling the light emitting diodes and the pick-ups, the controller including a plurality of dials and a slider.

15. A reconfigurable guitar system (10) for separating laterally spaced body regions (12) from a central neck portion (14) and central core portion (16) and for coupling any of a plurality of laterally spaced body regions to the neck portion and core portion, the separating and the coupling being done in a safe, convenient, and economical manner, the system comprising, in combination:

the central neck portion (14) having a first length and a first width, the central core portion (16) having a second length and a second width, the first length being greater than the second length, the first width being less than the second width, the central core portion having a planar left lateral edge (20) with a length, the central core portion having a planar right lateral edge (22) with a length, the length of the planar left lateral edge being greater than the length of the planar right lateral edge;

the laterally spaced body regions (12) including left body region (26) and a right body region (28), the left body region including a planar interior edge (30) of a same size and shape corresponding to the planar left lateral edge of the central core portion, the left body region also including a non-planar exterior edge (32), the interior and exterior edges of the left body regions forming a continuous periphery with a hollow center, the right body region including a planar interior edge (34) of a same size and shape corresponding to the planar right lateral edge of the central core portion, the right body region also including a non-planar exterior edge (36), the interior and exterior edges of the right body regions forming a continuous periphery with a hollow center; and left coupling components separably coupling the planar interior edge of the left body region to the left lateral edge of the central core portion, the left and right coupling components including outwardly extending pins (36) on the left and right edges of the central core portion, the left and right coupling components including apertures (38) on the left and right interior edges of the left and right body regions, the apertures adapted to removably receive the pins for coupling and uncoupling the left and right body regions to the core portion.

* * * * *